US012600589B2

(12) United States Patent
Wetsch

(10) Patent No.: US 12,600,589 B2
(45) Date of Patent: Apr. 14, 2026

(54) ROLL DISPENSER FOR SUPPORTING ROLL OF PACKAGING MATERIAL

(71) Applicant: Pregis LLC, Chicago, IL (US)

(72) Inventor: Thomas D. Wetsch, Naples, FL (US)

(73) Assignee: Pregis LLC, Chicago, IL (US)

( * ) Notice: Subject to any disclaimer, the term of this patent is extended or adjusted under 35 U.S.C. 154(b) by 194 days.

(21) Appl. No.: 18/459,297

(22) Filed: Aug. 31, 2023

(65) Prior Publication Data

US 2024/0067478 A1 Feb. 29, 2024

Related U.S. Application Data

(60) Provisional application No. 63/374,236, filed on Aug. 31, 2022.

(51) Int. Cl.

| | |
|---|---|
| ***B65H 16/00*** | (2006.01) |
| ***B65B 41/12*** | (2006.01) |
| ***B65H 16/06*** | (2006.01) |

(52) U.S. Cl.

CPC ..... *B65H 16/005* (2013.01); *B65B 41/12* (2013.01); *B65H 16/06* (2013.01); *B65H 2403/725* (2013.01); *B65H 2701/1842* (2013.01)

(58) Field of Classification Search

CPC .. B65H 16/005; B65H 16/06; B65H 2403/72; B65H 2403/725; B65H 2701/1842; B65H 2301/41306; B65H 2301/41346; B65H 2801/63; B65H 75/185; B65H 2701/1944; B65H 16/04; B65H 23/06; B65H 19/126; B65H 2403/52; B65B 41/12

USPC ..... 242/404.1, 404.3

See application file for complete search history.

(56) References Cited

U.S. PATENT DOCUMENTS

| | | | | |
|---|---|---|---|---|
| 1,665,272 A * | 4/1928 | Myers | E06B 9/50 242/596.5 |
| 3,610,643 A * | 10/1971 | Thompson | B65H 16/06 279/2.12 |
| 4,121,783 A * | 10/1978 | Wolfinger | B65H 75/08 242/596.7 |
| 4,234,134 A | 11/1980 | Rhine | |
| 4,248,392 A | 2/1981 | Parry | |
| 4,522,348 A * | 6/1985 | Strout | B65H 23/06 53/399 |

(Continued)

FOREIGN PATENT DOCUMENTS

| | | |
|---|---|---|
| EP | 0 551 249 A1 | 7/1993 |
| EP | 3100960 B1 | 12/2018 |

(Continued)

*Primary Examiner* — William A. Rivera

(74) *Attorney, Agent, or Firm* — Fox Rothschild LLP

(57) ABSTRACT

A roll dispenser is arranged to support a roll of packaging material, and includes a chuck assembly with a first chuck unit that includes a first plug received in a first axial end of a core of the roll, a first shaft fixed to the first plug, a first mount brought into engagement with the first shaft, and a first brake connected to the first plug and the first mount to establish friction between the first plug and the first mount. A first handle assembly may adjust a first compressive force applied axially between the first mount and the first shaft to regulate the friction between the first plug and the first mount. The chuck assembly also may include a second chuck unit received in a second axial end of the core for additionally supporting the roll of packaging material.

21 Claims, 14 Drawing Sheets

(56) References Cited

U.S. PATENT DOCUMENTS

| | | | | |
|---|---|---|---|---|
| 4,915,319 | A * | 4/1990 | Gerber | G01D 15/28 242/596.4 |
| 9,376,280 | B2 | 6/2016 | Page et al. | |
| 9,701,091 | B2 | 7/2017 | Page et al. | |
| 10,227,195 | B2 | 3/2019 | Page et al. | |
| 11,260,615 | B2 | 3/2022 | Cheich et al. | |
| 11,383,476 | B2 | 7/2022 | Wagner et al. | |
| 2004/0084559 | A1* | 5/2004 | Fraser | B65H 23/063 242/422.4 |

FOREIGN PATENT DOCUMENTS

| | | | |
|---|---|---|---|
| GB | 2 121 001 | * | 12/1983 |
| WO | 2010/089584 | A1 | 8/2010 |
| WO | 2014/014905 | A1 | 1/2014 |
| WO | 2014/201284 | A2 | 12/2014 |
| WO | 2022/024000 | A1 | 2/2022 |
| WO | 2022/124990 | A1 | 6/2022 |

* cited by examiner

ROLL DISPENSER FOR SUPPORTING ROLL OF PACKAGING MATERIAL

CROSS-REFERENCE TO RELATED APPLICATION

This application claims under 35 U.S.C. § 119(e) the benefit of U.S. Provisional Patent Application No. 63/374,236, filed on Aug. 31, 2022, the entire contents of which are incorporated herein by reference.

BACKGROUND

(a) Technical Field

The present disclosure relates to systems that convert roll stock packaging material such as paper-based roll stock and other materials into protective packaging, more particularly, to a roll dispenser for supporting a roll of packaging material.

(b) Description of the Related Art

Protective packaging, or dunnage, is produced by crumpling or otherwise deforming a stock material. For example, dunnage can be produced by running a generally continuous strip of stock material through a dunnage conversion machine. The dunnage conversion machine converts the stock material into a lower density dunnage material. The resulting dunnage can be cut into desired lengths to effectively fill a void space within a container holding a product. The dunnage material may be produced on an as-needed basis for an individual or a machine performing packing operations.

SUMMARY

Roll stock used for producing protective packaging material includes plastic and paper-based roll stock, including heavy duty, commercial and industrial bubble rolls, void-fill paper packaging, surface protection paper, grocery and foodservice paper, and printed/laminated film.

Paper-based dunnage materials possess a variety of advantages when employed as a dunnage material. In one aspect, paper-based dunnage materials can provide protection to prevent damage from shock and vibration. In another aspect, paper possesses higher biodegradation rates compared to other types of packaging material, such as plastics. In a further aspect, paper is very easy to recycle. In an additional aspect, paper is a sustainable material, as it is primarily composed of forestry products found in nature.

Expandable paper (or "extensible paper") is one example of a paper-based dunnage material. The stock paper material includes slits formed therein. When the stock paper is pulled from a dispenser, tension is applied to the dispensed paper, causing the slits to open, forming a lattice structure. This lattice structure can provide protective cushioning or interleaving for fragile products. Additionally, the lattice structure of the expandable paper can nest to itself, reducing or eliminating the need for tape or other adhesives to hold the expandable paper in place.

It can be appreciated, however, that realization of these benefits of expandable paper depends, at least in part, on the ability of the dispenser to apply tension approximately uniformly to the dispensed paper and at an appropriate target level. In one aspect, if tension is not applied approximately uniformly, where the tension is significantly higher or lower in certain regions as compared to others, the resultant lattice structure can be non-uniform. In one aspect, application of tension significantly lower than the target level can result in partial or no formation of the lattice structure. In another aspect, application of tension significantly higher than the target can result in damage (e.g., tearing) of the dispensed paper. In either case, the lattice of the dispensed paper can be incomplete and/or damaged, compromising its protective cushioning or interleaving capabilities.

Accordingly, there exists a need for a dispenser capable of dispensing continuous, expandable/extensible stock materials, such as paper while applying substantially uniform tension thereto.

A roll dispenser may include a chuck assembly and a base. The chuck assembly preferably includes a first chuck unit and a base for receiving the first chuck unit. The first chuck unit includes a compression train including a first side and a second side. The first side of the compression train may include at least an anti-rotation element. The second side of the compression train may include at least a first plug configured to engage a core of a roll of stock material. A first brake is operably associated with the first plug and the anti-rotation element so as to establish friction therebetween that resists rotation of the first plug with respect to the anti-rotation element as the packaging material is pulled from the roll. A first handle assembly may be configured to adjust a compressive force applied between the first and second sides of the compression train. The base is configured to support the chuck assembly at the anti-rotation element. When the chuck assembly is supported by the base, the second side of the compression train is configured to rotate about a rotation axis and the first side of the compression train is inhibited from rotation about the rotation axis by the anti-rotation element and the base. By providing the above arrangement of the chuck assembly and the base, it is possible to apply a substantially uniform tension to open expandable paper that is preferably provided in the roll of stock material. In particular, the expandable paper (also referred to as extensible paper) is typically formed with a plurality of slits that may be opened under tension, where the compressive force may be adjusted by the first handle assembly.

According to the present disclosure, a roll dispenser for supporting a roll of packaging material includes: a base; and a chuck assembly including a first chuck unit, where the first chuck unit comprises: a first mount mounted to the base such that the base limits rotation of the first mount mounted thereto; a first plug configured to be inserted in a first axial end of a core of the roll of packaging material and locked into rotation with the core; and a first brake operably associated with the first plug and the first mount so as to establish friction therebetween that resists rotation of the first plug with respect to the first mount as the packaging material is pulled from the roll.

The roll dispenser may further include a first handle assembly connected to the first plug, and configured to adjust a first compressive force applied in an axial direction so as to regulate the friction between the first mount and the first plug.

The first plug may include a distal portion for insertion in the first axial end of the core of the roll of packaging material, and a proximal portion defining a first shaft.

The roll dispenser may further include a pressure cap arranged between the first mount and the first handle assembly, wherein the pressure cap defines a cavity dimensioned to receive at least a portion of the first shaft. A spring may be positioned around an outer circumference of the first shaft and between an end of the first mount and an end of the pressure cap opposite the first handle assembly.

The first plug and the first shaft may be configured to rotate together about the rotation axis. The first handle assembly may be operably connected to the first shaft. The first handle assembly may be configured to be rotated manually by an operator or automatically by a machine.

The first plug may be configured to rotate about a rotation axis in the axial direction, while the first mount is inhibited from rotation about the rotation axis.

The roll of packaging material may include a roll of expandable paper having a plurality of slits. The first brake may be configured to regulate the friction between the first mount and the first plug so as to be sufficient to open one or more slits of the expandable paper without tearing the expandable paper.

The first mount may include a non-circular outer surface configured to contact the base so as to prevent rotation in the axial direction.

The chuck assembly may further include a second chuck unit including: a second plug configured to be received in a second axial end of the core of the roll of packaging material; a second shaft operably connected to the second plug; and a second mount configured to be connected to the second shaft. The second chuck unit may further include a second handle assembly configured to adjust a second compressive force applied in the axial direction between the second mount and the second shaft.

According to the present disclosure, a base for a roll dispenser configured to support a roll of packaging material includes: a base support extending in a longitudinal direction; and a pair of supports extending transversely from the base support, the pair of supports each defining a first end and a second end, wherein the first end of each of the pair of supports is mounted to a first surface of the base support, where at least one slot is formed adjacent to the second end of each of the pair of supports, and where the at least one slot of a first support of the pair of supports is configured to receive the first mount of the first chuck unit and the at least one slot of a second support of the pair of supports is configured to receive the second mount of the second chuck unit to thereby support the chuck assembly.

The base support may be configured to be mounted to a vertical wall such that the base support is substantially flush with the vertical wall, or to be mounted on a horizontal surface. The at least one slot may include a stepped entry area for receiving the first mount or the second mount, and a recessed area for holding the first mount or the second mount by gravity. The at least one slot may include a first slot and a second slot, where the first slot extends from the second end of each of the pair of second supports, and where the second slot extends from a side of each of the pair of supports, the side being positioned between the first and second ends of the pair of supports.

According to the present disclosure, a system for dispensing packaging material from a roll arranged on a roll dispenser includes: a base; a chuck assembly including a first chuck unit, where the first chuck unit includes a first plug configured to be inserted in a first axial end of a core of the roll of packaging material and locked into rotation with the core, and a first brake configured to brake rotation of the first plug and the core as the packaging material is pulled from the roll; and the roll of packaging material being supported by the base with the first plug inserted into the core.

The system may further include a first mount mounted to the base such that the base limits rotation of the first mount mounted thereto.

The roll of packaging material may include a roll of expandable paper comprising a plurality of slits, and the first brake is configured to regulate the friction between the first mount and the first plug so as to be sufficient to open one or more slits of the expandable paper without tearing the expandable paper.

The chuck assembly may further include a second chuck unit including: a second plug configured to be received in a second axial end of the core of the roll of packaging material; a second shaft operably connected to the second plug; and a second mount configured to be connected to the second shaft.

DETAILED DESCRIPTION

Figure 2:
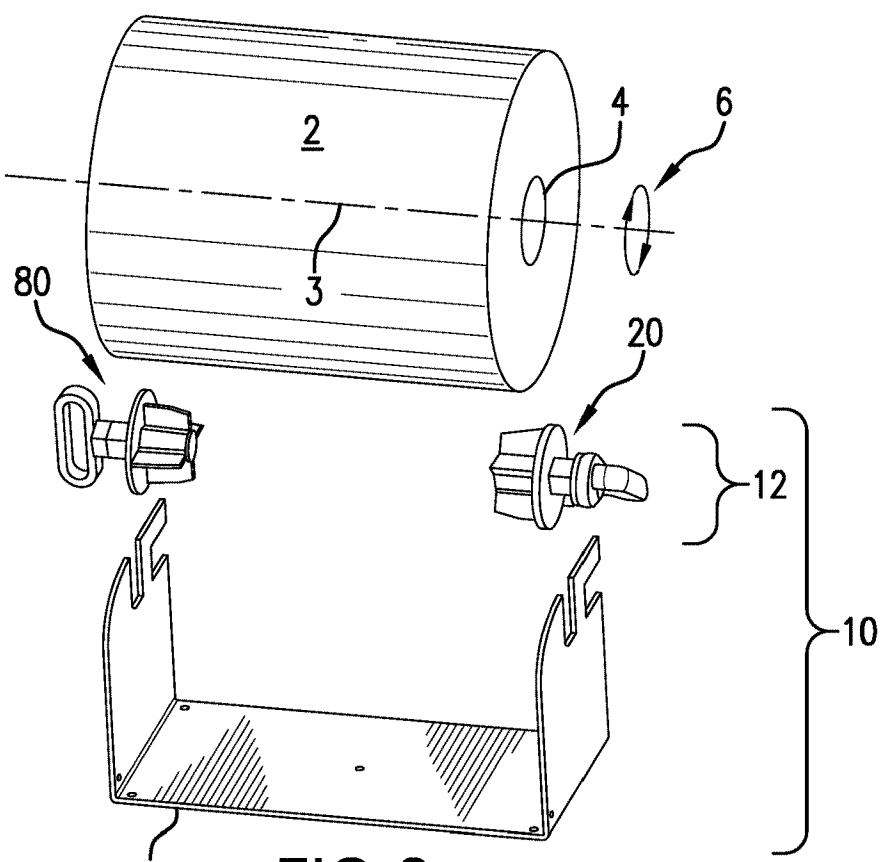
FIG. 2 is an exploded perspective view of the roll dispenser of FIG. 1.

The following discussion omits or only briefly describes conventional features of the disclosed technology that are apparent to those skilled in the art. Reference to various embodiments does not limit the scope of the claims attached hereto. Additionally, any examples set forth in this specification are intended to be non-limiting and merely set forth some of the many possible embodiments for the appended claims. Further, particular features described herein can be used in combination with other described features in each of the various possible combinations and permutations. A person of ordinary skill in the art would know how to use the instant invention, in combination with routine experiments, to achieve other outcomes not specifically disclosed in the examples or the embodiments.

Unless otherwise specifically defined herein, all terms are to be given their broadest possible interpretation including meanings implied from the specification as well as meanings understood by those skilled in the art and/or as defined in dictionaries, treatises, etc. Unless defined otherwise, all technical and scientific terms used herein have the same meaning as commonly understood by one of ordinary skill in the art in the field of the disclosed technology. It must also be noted that, as used in the specification and the appended claims, the singular forms "a," "an" and "the" include plural referents unless otherwise specified, and that the terms "includes" and/or "including," when used in this specification, specify the presence of stated features, elements, and/or components, but do not preclude the presence or addition of one or more other features, steps, operations, elements, components, and/or groups thereof. Additionally, methods, equipment, and materials similar or equivalent to those described herein can also be used in the practice or testing of the disclosed technology.

Various examples of the disclosed technology are provided throughout this disclosure. The use of these examples is illustrative only, and in no way limits the scope and meaning of the invention or of any exemplified form. Likewise, the invention is not limited to any particular preferred embodiments described herein. Indeed, modifications and variations of the invention may be apparent to those skilled in the art upon reading this specification, and can be made without departing from its spirit and scope. The invention is therefore to be limited only by the terms of the claims, along with the full scope of equivalents to which the claims are entitled.

Certain relationships between features of the suppressor are described herein using the term "substantially" or "substantially equal." As used herein, the terms "substantially" and "substantially equal" indicate that the equal relationship is not a strict relationship and does not exclude functionally similar variations therefrom. Unless context or the description indicates otherwise, the use of the term "substantially" or "substantially equal" in connection with two or more described dimensions indicates that the equal relationship between the dimensions includes variations that, using mathematical and industrial principles accepted in the art (e.g., rounding, measurement or other systematic errors, manufacturing tolerances, etc.), would not vary the least significant digit of the dimensions. As used herein, the term "substantially parallel" indicates that the parallel relationship is not a strict relationship and does not exclude functionally similar variations therefrom. As used herein, the term "substantially orthogonal" indicates that the orthogonal relationship is not a strict relationship and does not exclude functionally similar variations therefrom.

Systems for converting a high-density stock material into low-density dunnage are disclosed. The stock material is processed by a dispenser that is configured to apply tension substantially uniformly across a width of material dispensed from the dispenser. A supply of the stock material can be stored in a roll, and the stock material can be continuous or perforated. When the stock material is an expandable material, the applied tension causes the slits to open, forming a lattice structure. The dunnage containing this lattice structure can provide protective cushioning or interleaving for fragile products. In further embodiments of the dispenser, the amount of applied tension can be easily adjusted to allow for substantially complete lattice formation without damaging the dispensed dunnage.

Embodiments of the dispenser of the present disclosure are discussed herein in the context of paper stock materials. However, it may be understood that the disclosed embodiments may be employed with any suitable type of material. Examples may include, but are not limited to, pulp-based virgin and recycled papers, newsprint, cellulose and starch compositions, and poly or synthetic material (e.g., thermoplastic materials such as a web of plastic material), etc. Further examples of paper materials can possess a basis weight of about 20 lbs. to about 100 lbs. The stock material may further possess any other suitable characteristics, such as thickness, weight, and dimensions.

Figure 1:
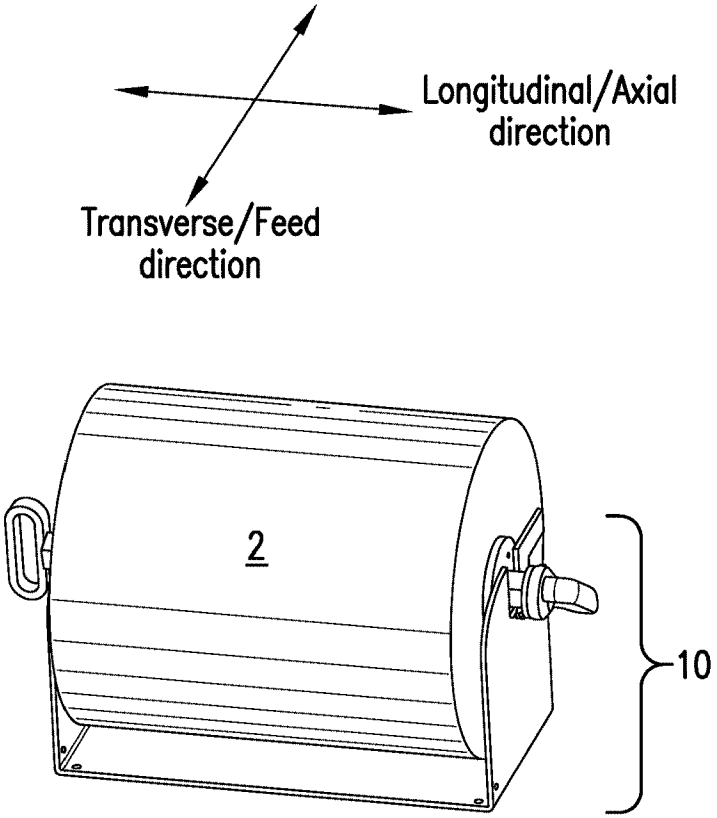
FIG. 1 is a perspective view of a first embodiment of a roll dispenser including a base and a chuck assembly having a first chuck unit and a second chuck unit.

FIG. 1 is a perspective view illustrating a roll dispenser 10 and a chuck assembly 12 including a first chuck unit 20 and a second chuck unit 80 according to a first embodiment of the present disclosure, and FIG. 2 is exploded perspective view of the roll dispenser 10 of FIG. 1. Referring to FIGS. 1 and 2, the first chuck unit 20 is configured to apply a substantially uniform tension axially to a roll 2 of stock material arranged on the roll dispenser 10, including application of a compression force in an axial direction.

Referring to FIGS. 1-2, the roll dispenser 10 includes a base 30 and the first and second chuck units 20, 80 configured to be mounted to the base 30. According to the first embodiment, the chuck assembly 12 includes the first chuck unit 20 and a second chuck unit 80. In other embodiments, the first and second chuck units 20, 80 may be replaced by a single chuck unit as described herein.

Figure 3:
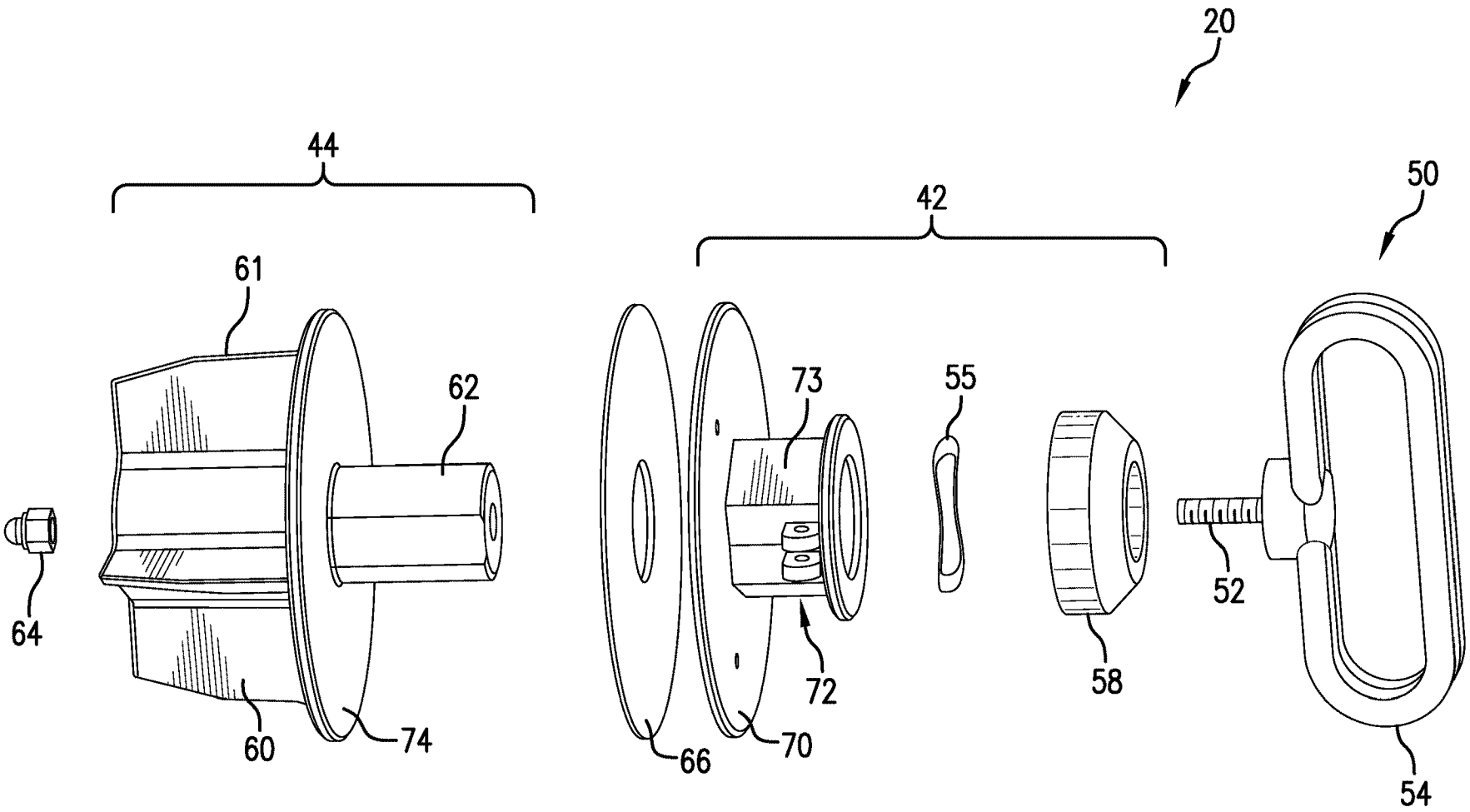
FIG. 3 is an exploded view of the first chuck unit of the chuck assembly of FIG. 2.

Referring to FIG. 3, the first chuck unit 20 may include a compression train having a first side 42 and a second side 44, and an interface 50. The interface 50 is configured to adjust a compressive force applied between the first and second sides 42, 44 of the compression train. The base 30 may be configured to engage and support the first chuck unit 20. When the first chuck unit 20 is engaged with the base 30, the second side 44 of the compression train and the roll 2 of stock material coupled thereto can be configured to rotate about a rotation axis of the roll 2. Additionally, when the first chuck unit 20 is engaged with the base 30, the first side 42 of the compression train can be inhibited from rotation about the rotation axis.

As discussed in greater detail below, in certain embodiments, the interface 50 can include a first threaded rod 52 coupled to a member (e.g., a first handle 54) capable of being grasped by a user (i.e., human operator) or otherwise engaged by a machine for rotation of the threaded rod, e.g., the first handle 54, a knob, etc. For purposes of the discussion below, the terms "handle" or "knob" will be employed. However, it may be understood that the member included as part of the interface 50 may adopt other forms without limitation.

The first threaded rod 52 may extend along part of or an entire length of the compression train. For example, the first threaded rod 52 preferably terminates at a first plug 60. So configured, the interface 50 may be rotated manually by a user, or automatically by a machine. Contact between surfaces of components of the first chuck unit 20 results in friction. Accordingly, the frictional force resisting rotation of the second side 44 of the compression train, and the roll 2 of stock material coupled thereto, can be dependent upon the applied compressive force and is adjustable by the interface 50.

In alternative embodiments (not shown), rotation of the interface 50 may be controlled by a machine. For example, the machine may be coupled directly to the first threaded rod 52 (e.g., by a motor and drive train). In such configurations, a handle or knob may be omitted, as the machine may directly control rotation of the first threaded rod 52 without the need to grip any component manually.

The compression train may optionally include one or more components to facilitate adjustment of resistance to rotation. The one or more components may be positioned on the first side 42 of the compression train, the second side 44 of the compression train, or both sides thereof. Thus, the compressive force applied between the first and second sides 42, 44 of the compression train becomes the net of the compressive force applied by the interface 50 and the opposing tensile force produced by frictional forces between components of the first and second sides 42, 44 of the compression train. Alternatively or additionally, the one or more components can include bearing surfaces (not shown) for transmission of the compressive force within the compression train.

Further, in one embodiment, the one or more components can include a spring 55 (see FIG. 3). In general, the spring 55 may be configured to allow for more gradual changes in the compressive force. For example, when the spring 55 is compressed from its equilibrium position, it exerts an opposing force (a tensile force) in a direction toward the equilibrium position. This attenuation of the compressive force applied by the interface 50 can provide a more gradual change in the compressive force than that provided by the interface 50 alone. This in turn allows for more a more gradual change in the resistance to rotation of the roll 2 of stock material with respect to the base 30.

In use, the core 4 of the roll 2 of packaging material (e.g., expandable stock material) may be coupled axially to the first plug 60 for mounting to the roll dispenser 10. When the roll 2 of expandable stock material is mounted in the roll dispenser 10, and a first/outer layer of the expandable stock material is pulled away from the roll 2, then the roll 2 is urged to rotate, along with the second side 44 of the compression train, about the rotation axis. This rotation is opposed by the rotation resistance provided by the compressive force applied between the first and second sides 42, 44 of the compression train. The rotation resistance provided by the compressive force can be adjusted to a value that permits substantially uniform expansion of the expandable stock material concurrently with rotation of the roll 2 and dispensing of the expandable stock material. In this manner, development of non-uniform regions of expansion and/or tearing of the expandable stock material can be substantially avoided during dispensing.

Embodiments of the roll dispenser having different configurations are discussed in greater detail below.

FIGS. 2-9 are views of a first embodiment of the roll dispenser. Referring, e.g., to FIGS. 2-6, the roll dispenser 10 includes the base 30 and the chuck assembly 12, which includes the first chuck unit 20 and the second chuck unit 80. The base 30 includes a base support 32 extending in a longitudinal (or axial) direction and a pair of supports 34, 36 extending in an upright manner from a first end 31 and a second end 33 of the base support 32, respectively (see FIG. 7). Each of the pair of supports 34, 36 can be mounted to the base support 32 such that the pair of supports 34, 36 are offset from each other via a longitudinal offset 35. At least one slot (e.g., first and second slots 38, 39) may be formed adjacent to a free end 37 of each of the pair of supports 34, 36. As discussed in greater detail below, the at least one slot 38, 39 is configured to receive the first and second chuck units 20, 80 for mounting the roll 2 of stock material to the roll dispenser 10.

Figure 4:
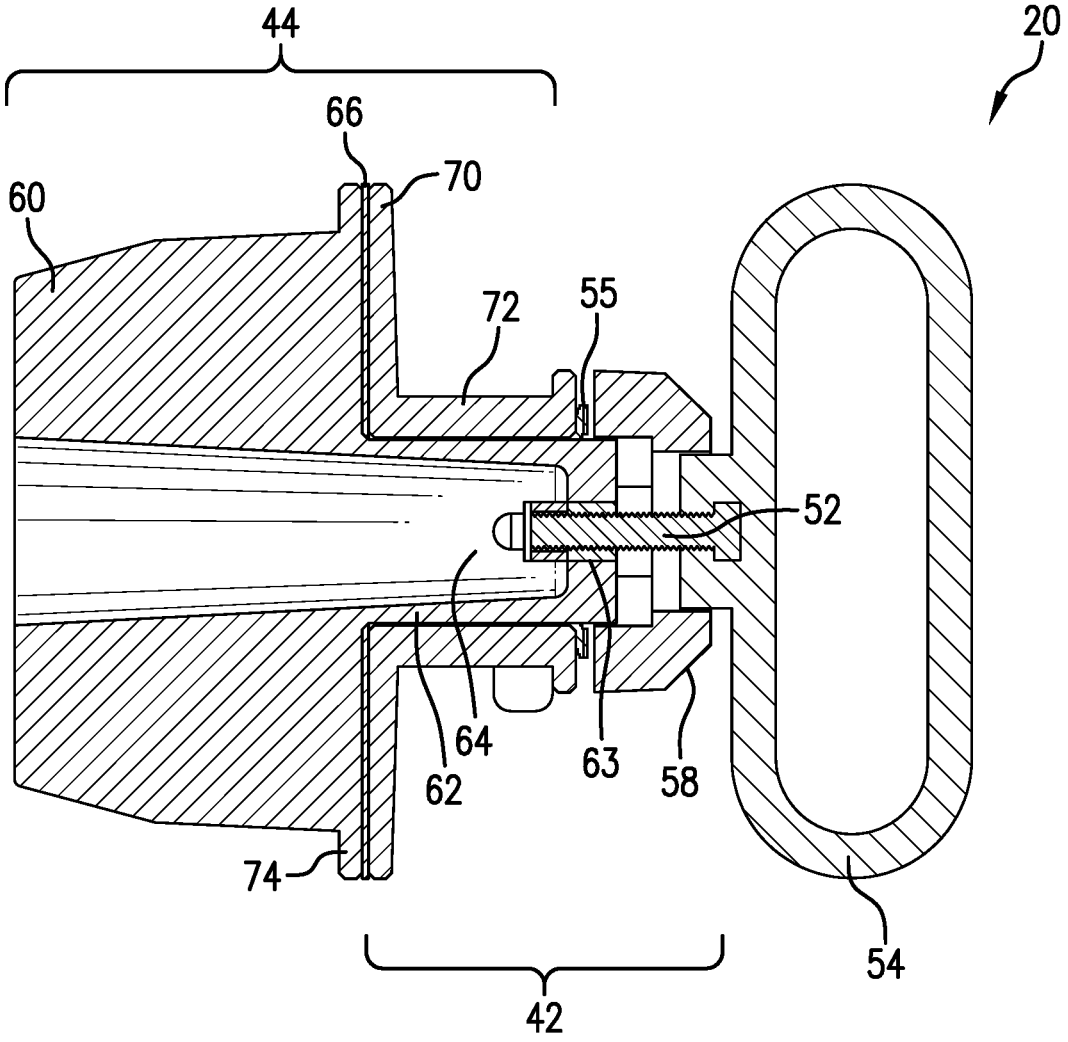
FIG. 4 is a cross-sectional view of the first chuck unit of the chuck assembly of FIG. 2.

The first chuck unit 20 is illustrated in greater detail in FIGS. 3-4. FIG. 3 is an exploded view, and FIG. 4 is an assembled, cross-sectional view of the first chuck unit 20. As shown, the first chuck unit 20 corresponds to the first and second sides 42, 44 of the compression train and the interface 50. The first side 42 of the compression train preferably includes a generally planar first pad 70, and a first mount 72 coupled to a first side of the first pad 70, where the first mount 72 serves as an anti-rotation element. The second side 44 of the compression train preferably includes a generally planar second pad 74. A first shaft 62 is coupled to a first side of the second pad 74, and the first plug 60 is coupled to a second side of the first pad 70.

As provided herein, the first and second pads 70, 74 constitute a first brake, and may be configured to form an area or region of surface contact (e.g., a plane) so as to establish frictional contact, where the first and second pads 70, 74 are preferably formed in approximately the same size and shape. The friction forces generated by contact between the first and second pads 70, 74 may be regulated by adjusting the compressive force via the interface (e.g., first handle assembly) 50. Preferably, when the roll 2 of packaging material is made of expandable paper, the first brake is operable to regulate the friction between the first mount 72 and the first plug 60 (e.g., between the first pad 70 connected to the first mount 72 and the second pad 74 connected to the first plug 60) so as to be sufficient to open one or more slits of the expandable paper without tearing the expandable paper.

The first chuck unit 20 includes at least the interface (e.g., first handle assembly) 50 that is operably connected to the first plug 60, and further includes the first mount 72 that is configured to engage the first plug 60, e.g., by enclosing or surrounding the first plug 60 such that the first plug 60 is able to rotate inside the first mount 72. The base 30 is configured to support the first chuck unit 20 via a fixed point of contact with the first mount 72, where the first plug 60 is configured to rotate about a rotation axis, and the first mount 72 is inhibited from rotation about the rotation axis by virtue of being fixed to the base 30.

Referring to FIG. 3, for example, the first mount 72 preferably includes a non-circular outer surface 73 (e.g., a square- or hexagonal-shaped surface having straight edges) such that the outer surface 73 may be limited from rotation when mounted to the base 30. In particular, when the first mount 72 is mounted to the base 30, because the first mount 72 includes the non-circular outer surface 73, rotation thereof within the base 30 will be substantially limited or prevented.

The first plug 60 includes a distal portion for insertion into a first axial end of the core 4 of the roll 2 of expandable stock material, and a proximal portion defining a first shaft 62. In particular, the first plug 60 may form an interference fit or otherwise be received in the core 4 of the roll 2 of expandable stock material, thereby locking into rotation with the core 4. In addition, the first plug 60 and the first shaft 62 are configured to rotate together about the rotation axis, where the first shaft 62 is configured to be operably connected with the interface (first handle assembly) 50. The first shaft 62 may be received coaxially inside of the first mount 72, but preferably makes minimal contact with the first mount 72, which is received in the base 30, thereby allowing the first plug 60 connected to the first shaft 62 to rotate freely in the axial direction.

The interface 50 includes the first handle 54, the first threaded rod 52 extending from the first handle 54, and a channel 63 formed in the first shaft 62. The first threaded rod 52 extends through the channel 63 and is secured to the first shaft 62. In one example, the first shaft 62 may be hollow and a nut 64 (e.g., a locking nut) may be positioned therein. The nut 64 may threadingly engage the first threaded rod 52 to secure the first threaded rod 52 (and the first handle 54) to the first shaft 62. The interface 50 adjusts the compressive force by rotating the first handle 54 to urge the first pad 70 and the second pad 74 toward or away from each other.

Optionally, a friction layer 66 may be provided on at least one of the first and second pads 70, 74. The friction layer 66 is formed from a material that increases friction arising from rotation of the second pad 74 with respect to the first pad 70 when the first and second pads 70, 74 are placed in contact with each other. In certain embodiments, the friction layer 66 may be formed from vinyl. However, other materials that increase friction between two surfaces in contact may be employed. In embodiments where two friction layers are employed, a first friction layer on the first pad 70 and a second friction layer on the second pad 74, the first and second friction layers may be formed from the same material or from different materials.

As shown in FIGS. 3-4, the first side 42 of the compression train can further include a pressure cap 58 and the spring 55. The pressure cap 58 is positioned between the first mount 72 and the first handle 54, and can further define a cavity dimensioned to receive a portion of the first shaft 62. The spring 55 may be positioned around an outer circumference of the first shaft 62 and between an end of the first mount 72 opposite the first pad 70 and an end of the pressure cap 58 opposite the first handle 54. As discussed above, the spring 55 is compressed (e.g., between the first mount 72 and the pressure cap 58) when the first handle 54 is rotated to urge the first and second pads 70, 74 into contact. The compressed spring exerts a tensile force when compressed, reducing the compressive force applied to the first and second sides 42, 44 of the compression train as a function of rotation of the first handle 54. Thus, with the spring 55 present, rotation of the first handle 54 results in a more gradual increase in the compressive force as compared to when the spring 55 is absent.

It can be understood that, in alternative embodiments, the spring 55 may be positioned at other locations within the first side 42 of the compression train or on the second side 44 of the compression train.

Figure 5:
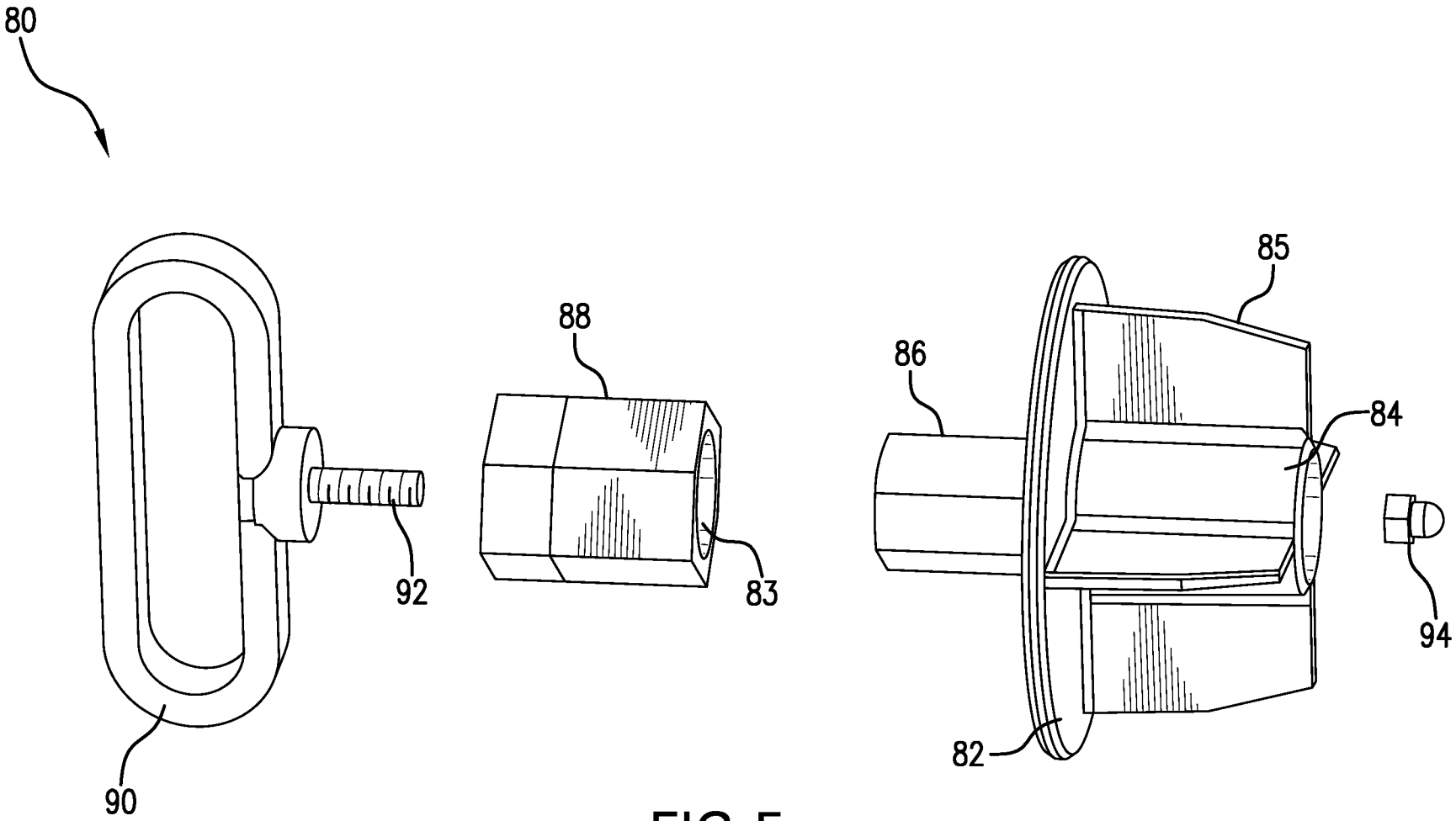
FIG. 5 is an exploded view of a second chuck unit of the chuck assembly of FIG. 2.
Figure 6:
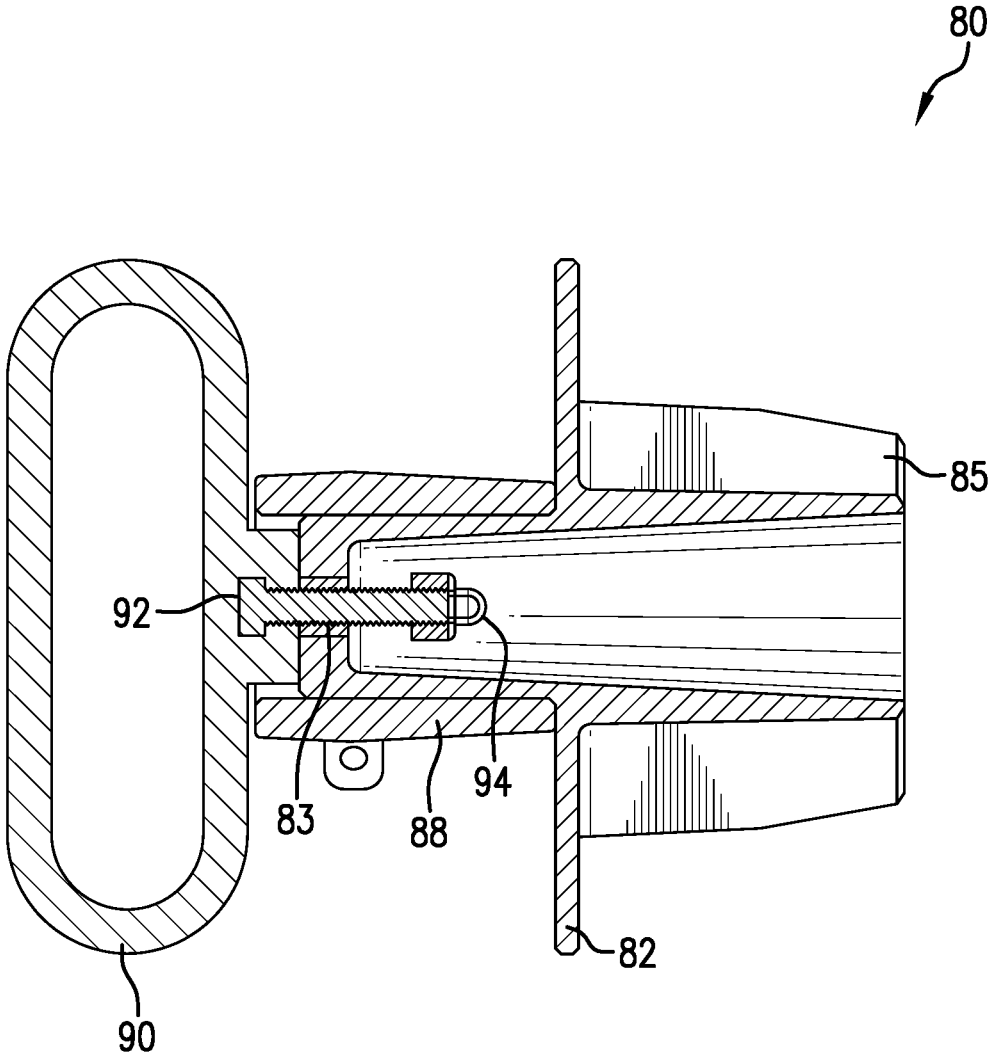
FIG. 6 is a cross-sectional view of the second chuck unit of the chuck assembly of FIG. 2.

The second chuck unit 80 is illustrated in greater detail in FIGS. 5-6. FIG. 5 is an exploded view, while FIG. 6 is an assembled, cross-sectional view. The second chuck unit 80 includes a generally planar pad 82, a second plug 84 coupled to a first side of the third base 82, a second shaft 86 coupled to a second side of the third base 82, a second mount 88, and a second handle 90.

The second handle 90 and the second plug 84 may be rigidly coupled together. As an example, the second threaded rod 92 may be coupled to the second handle 90 and be configured for engagement with the second shaft 86 and the second plug 84. For example, a channel 83 may be formed in the second mount 88. The second threaded rod 92 is configured to extend through the channel 83 and may be secured to the second shaft 86 via corresponding threads (e.g., a channel) in the second shaft 86. In one example, the second shaft 86 may be hollow and a nut 94 (e.g., a locking nut) may be positioned therein. The nut 94 may threadingly engage the second threaded rod 92 to secure the second threaded rod 92 (and the second handle 90) to the second shaft 86.

As shown in FIGS. 5-6, the second threaded rod 92 may be tightened via the second handle 90 to fix the handle 90 to the second plug 84. As a result, the second chuck unit 80 is locked into rotation with the core 4 of the roll 2 of packaging material. The second mount 88 may be received on the base 30, where the second mount 88 may have a circular or non-circular outer surface to be received in the base 30.

Referring again to FIGS. 1-2, the first and second chuck units 20, 80 may be received in at least one of the slots 38, 39 on the base 30. In particular, once assembled, the first and second chuck units 20, 80 are arranged such that the first plug 60 and the second plug 84 are configured to engage opposite ends of the core 4 of the roll 2 of stock material. As shown in FIG. 3, the first plug 60 may include a first plurality of ribs 61 mounted circumferentially around an internal shaft of the first plug 60. As shown in FIG. 5, the second plug 84 may include a second plurality of ribs 85 mounted circumferentially around an internal shaft of the second plug 84. Each of the first and second plurality of ribs 61, 85 may extend radially outward from the rotation axis when the first and second chuck units 20, 80 are mounted to the base 30.

The first and second plurality of ribs 61, 85 are dimensioned such that radially facing surfaces of the first and second plurality of ribs 61, 85 may contact an inner circumference of the core 4 of the roll 2 of stock material. In this manner, the first and second chuck units 20, 80 may be coupled to the roll 2 of stock material by an interference fit between the core 4 and the first and second plugs 60, 84, respectively.

As provided herein, the first and second chuck units 20, 80 may be provided on opposite ends of the roll 2 of stock material according to one or more embodiments of the present disclosure. For example, in one embodiment, it is possible to provide two of the first check units 20 on the opposite ends of the roll 2. Alternatively, in another embodiment, it is possible to provide two of the second chuck units 80 on the opposite ends of the roll 2. In certain embodiments, the opposite ends of the roll 2 will include one of the first chuck units 20 and one of the second chuck units 80.

Figure 7:
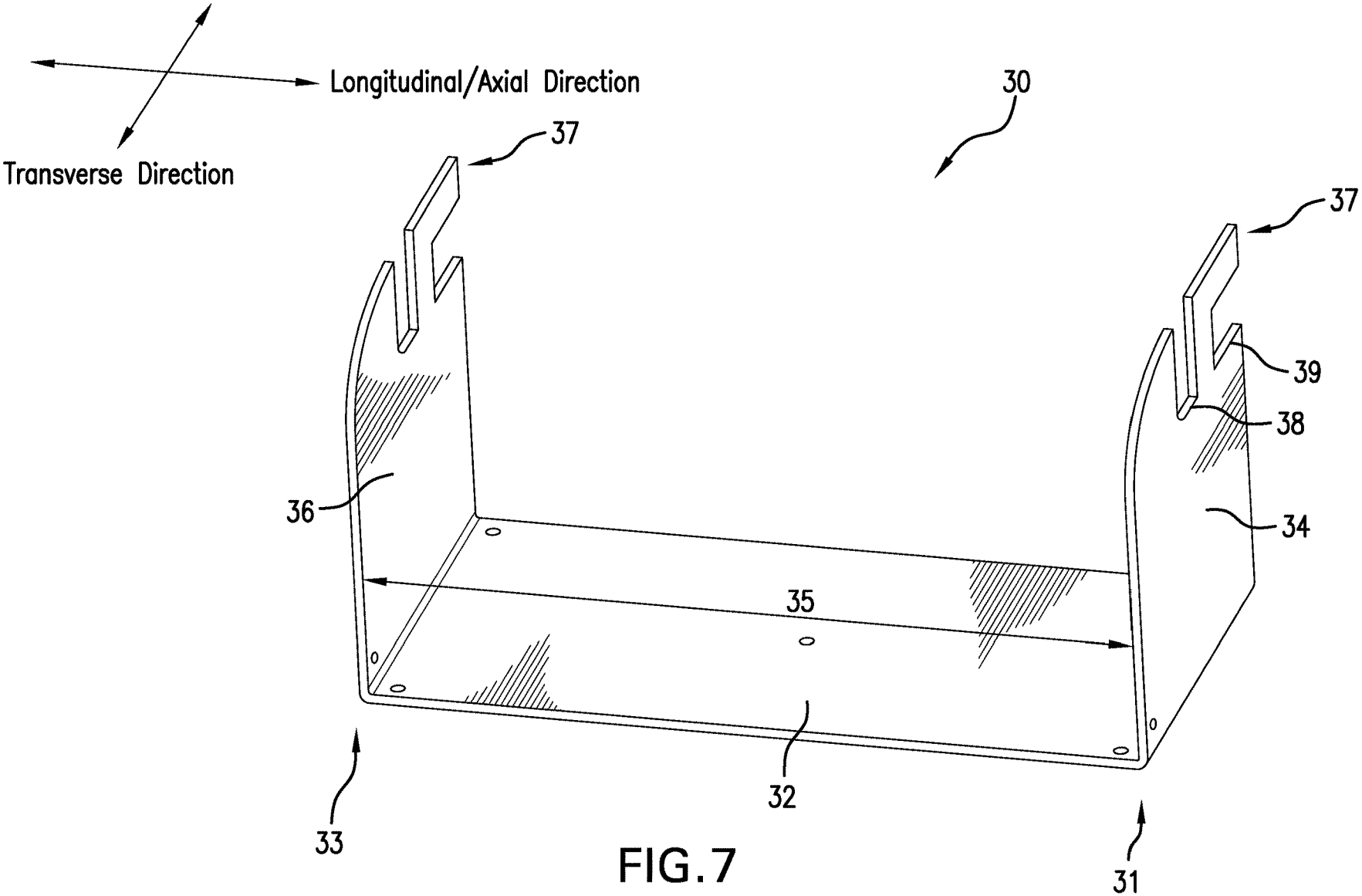
FIG. 7 is a perspective view of the base of the roll dispenser of FIGS. 1-2.

FIG. 7 is a perspective view of the base 30 of the roll dispenser 10 of FIGS. 1-2. As shown, the base 30 includes the base support 32 extending in a longitudinal direction and the pair of supports 34, 36. The supports 34, 36 extend from the first end 31 and the second end 33 of the base support 32, respectively, to respective free ends 37. The pair of supports 34, 36 may be generally planar and mounted to the base support 32 substantially parallel to each other, while being arranged substantially orthogonal to the base support 32. In addition, the pair of supports 34, 36 are longitudinally offset from each other by the longitudinal offset 35.

The at least one slot (e.g., the first and second slots 38, 39) is further formed at the free ends 37 of the pair of supports 34, 36, i.e., away from an intersection between the supports 34, 36 and the base support 32. In one embodiment, the at least one slot includes the first slot 38 extending from the free end 37 of each of the pair of supports 34, 36. In another embodiment, the at least one slot may further include the second slot 39 extending from a side of each of the pair of supports 34, 36. In certain embodiments, only the first slot 38 or the second slot 39 is provided. In other embodiments, both of the first and second slots 38, 39 are provided.

The at least one slot of the first support 34 is configured to receive the first mount 72 of the first chuck unit 20 (see FIGS. 3-4), and the at least one slot of the second support 36 is configured to receive the second mount 88 of the second chuck unit 80 (see FIGS. 5-6). In this manner, the chuck assembly 12 may be supported by the base 30, along with the roll 2 of stock material coupled to the chuck assembly 12. Because the first mount 72, e.g., is received in the at least one slot of the base 30, the base 30 itself does not need to be adjustable. Instead, resistance occurs within the chuck assembly 12 itself. In the case of the first mount 72, which may be fixed to the base 30 during use, adjustability of the compression force is carried out via the interface (e.g., first handle assembly) 50.

Figure 8:
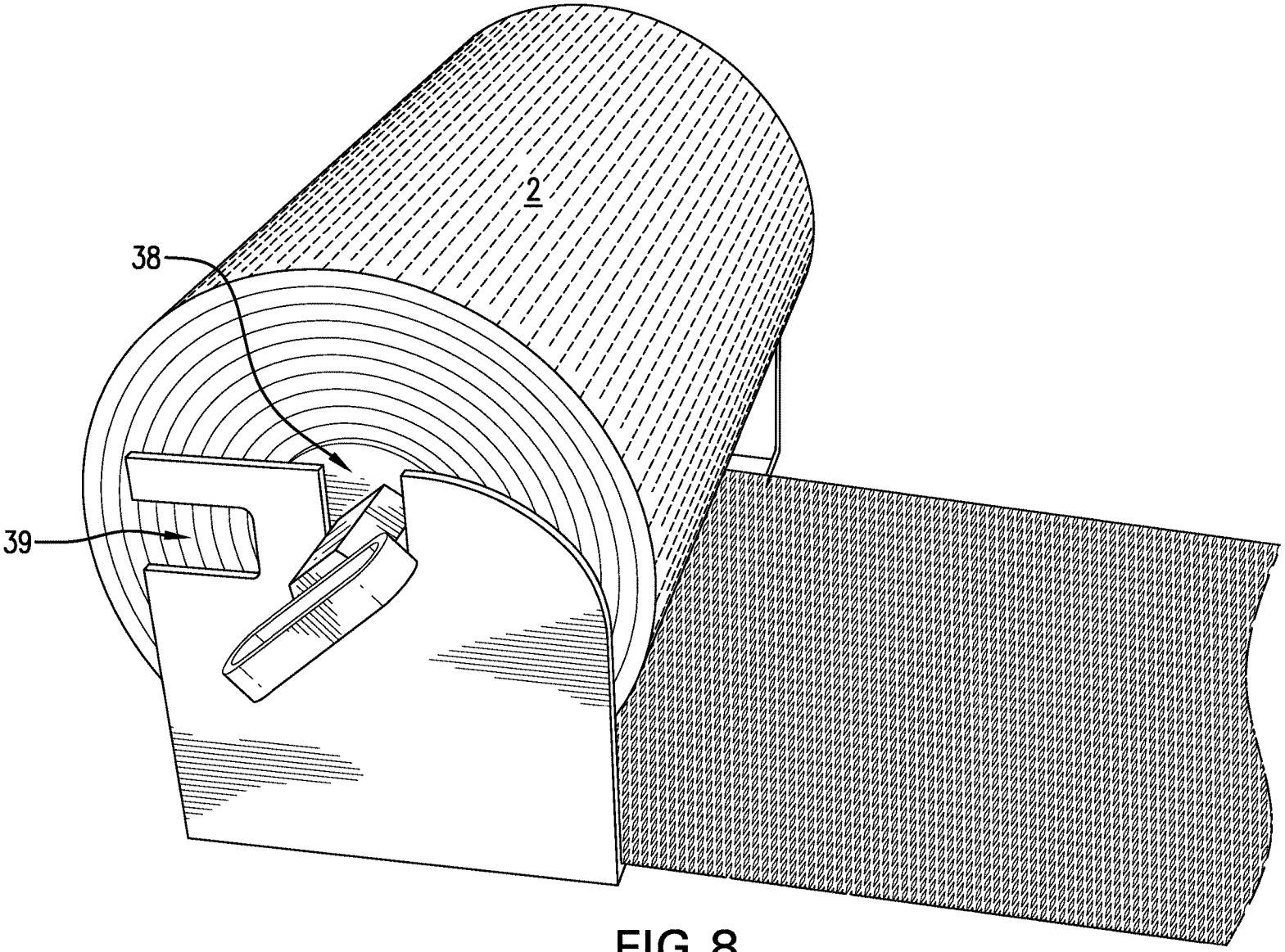
FIG. 8 is a view of the roll dispenser of FIGS. 1-2 in a first orientation.
Figure 9:
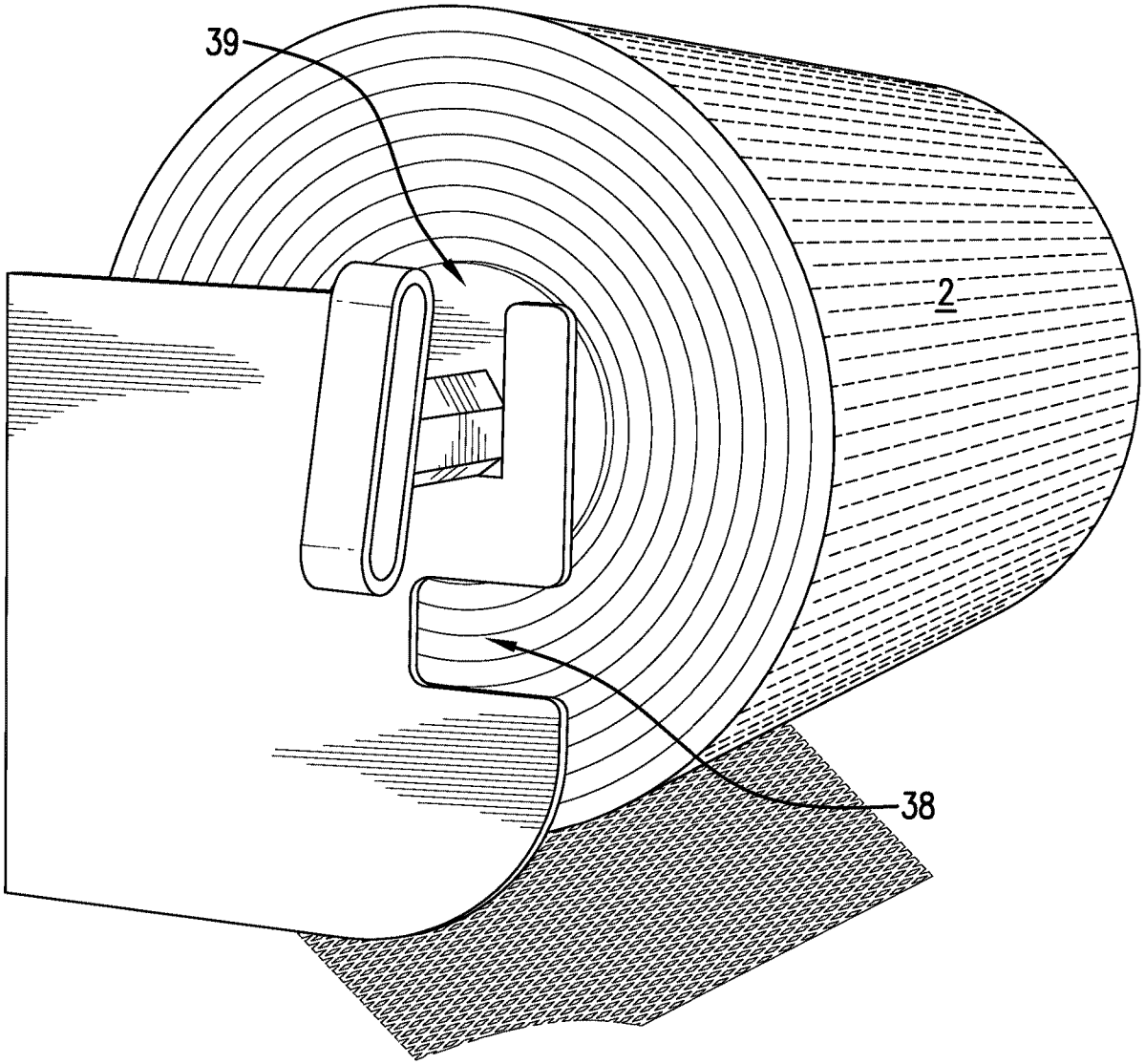
FIG. 9 is a view of the roll dispenser of FIGS. 1-2 in a second orientation.

As further illustrated in FIGS. 8-9, the first and second slots 38, 39 are configured to facilitate mounting of the roll 2 of stock material in different orientations with respect to the base support 32 of the base 30. For example, the supports 34, 36 may each include a substantially similar or identical arrangement of the first and second slots 38, 39 in which both of the first and second slots 38, 39 are present on both of the supports 34, 36.

FIG. 8 is a view of the roll dispenser 10 of FIGS. 1-2 in a first orientation, e.g., in which the first and second chuck units 20, 80 are received within the first slots 38. When the roll dispenser 10 is placed on a horizontal surface (i.e., the base layer 30 is placed in contact with the horizontal surface), the first slots 38 extend from the free ends 37 of the supports 34, 36 toward the base support 32. Thus, the force of gravity is applied to the roll 2 to retain the first and second chuck units 20, 80 within the first slots 38.

FIG. 9 is a view of the roll dispenser 10 of FIGS. 1-2 in a second orientation, where the first and second chuck units 20, 80 are received within the second slots 39. When the roll dispenser 10 is mounted to a vertical wall, e.g., with the base support 32 placed in contact with the vertical wall, the second slots 39 are oriented vertically. Thus, the force of gravity is applied to the roll 2 to retain the first and second chuck units 20, 80 within the second slots 39.

Figure 10:
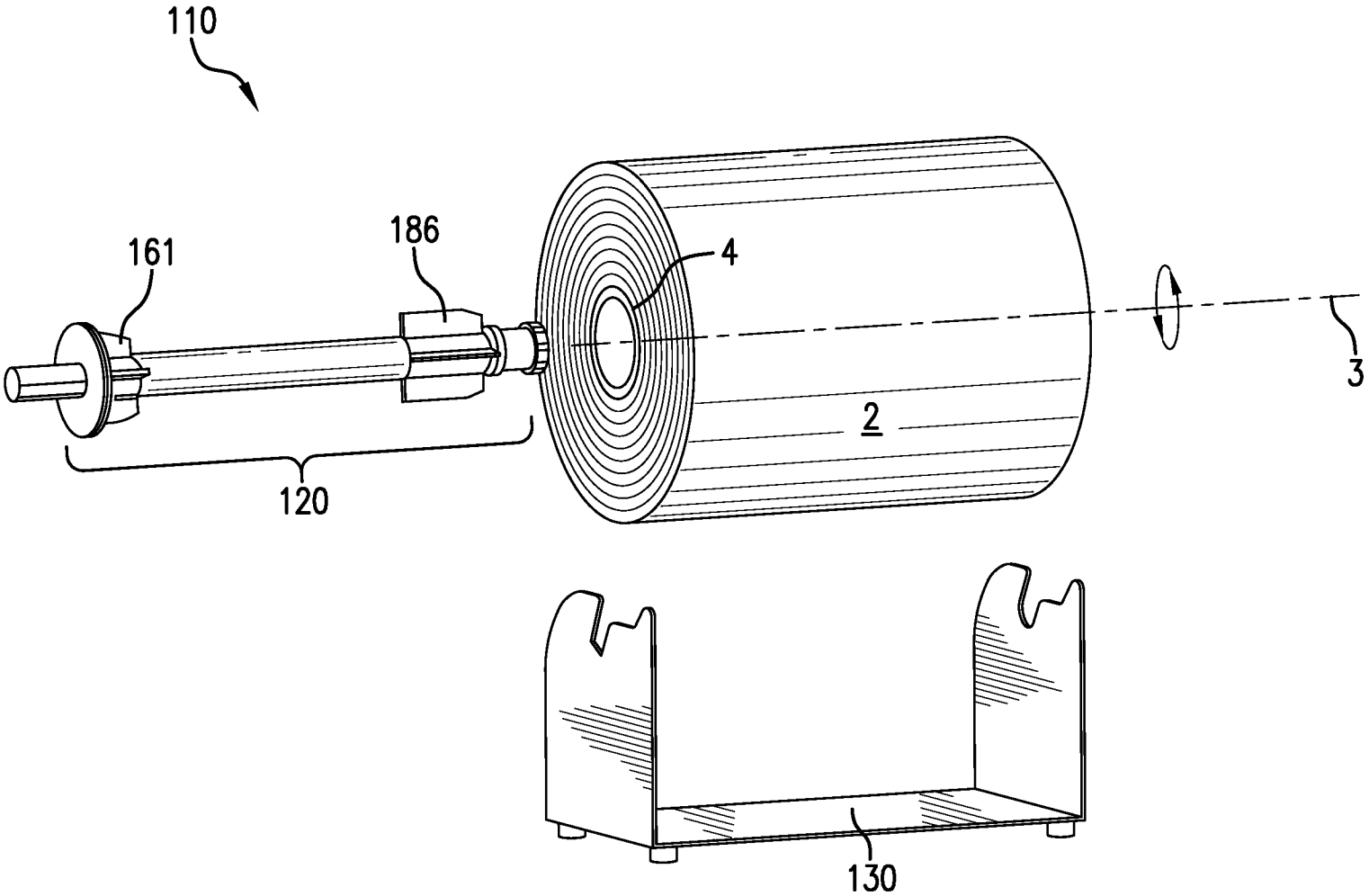
FIG. 10 is an exploded perspective view of a second embodiment of the roll dispenser including a base and a single chuck unit including a plurality of plugs.
Figure 11:
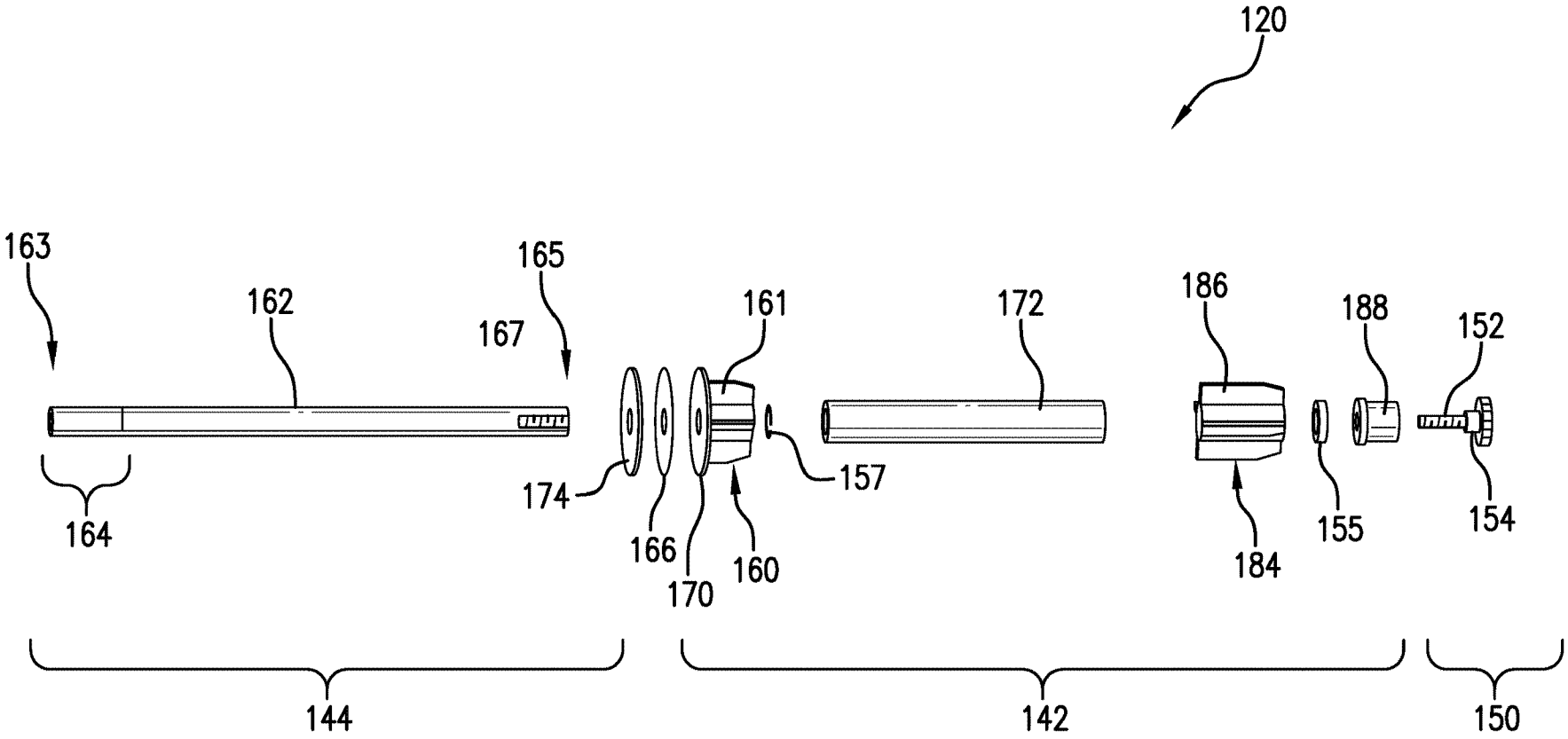
FIG. 11 is an exploded view of the chuck assembly of the roll dispenser of FIG. 10.
Figure 12:
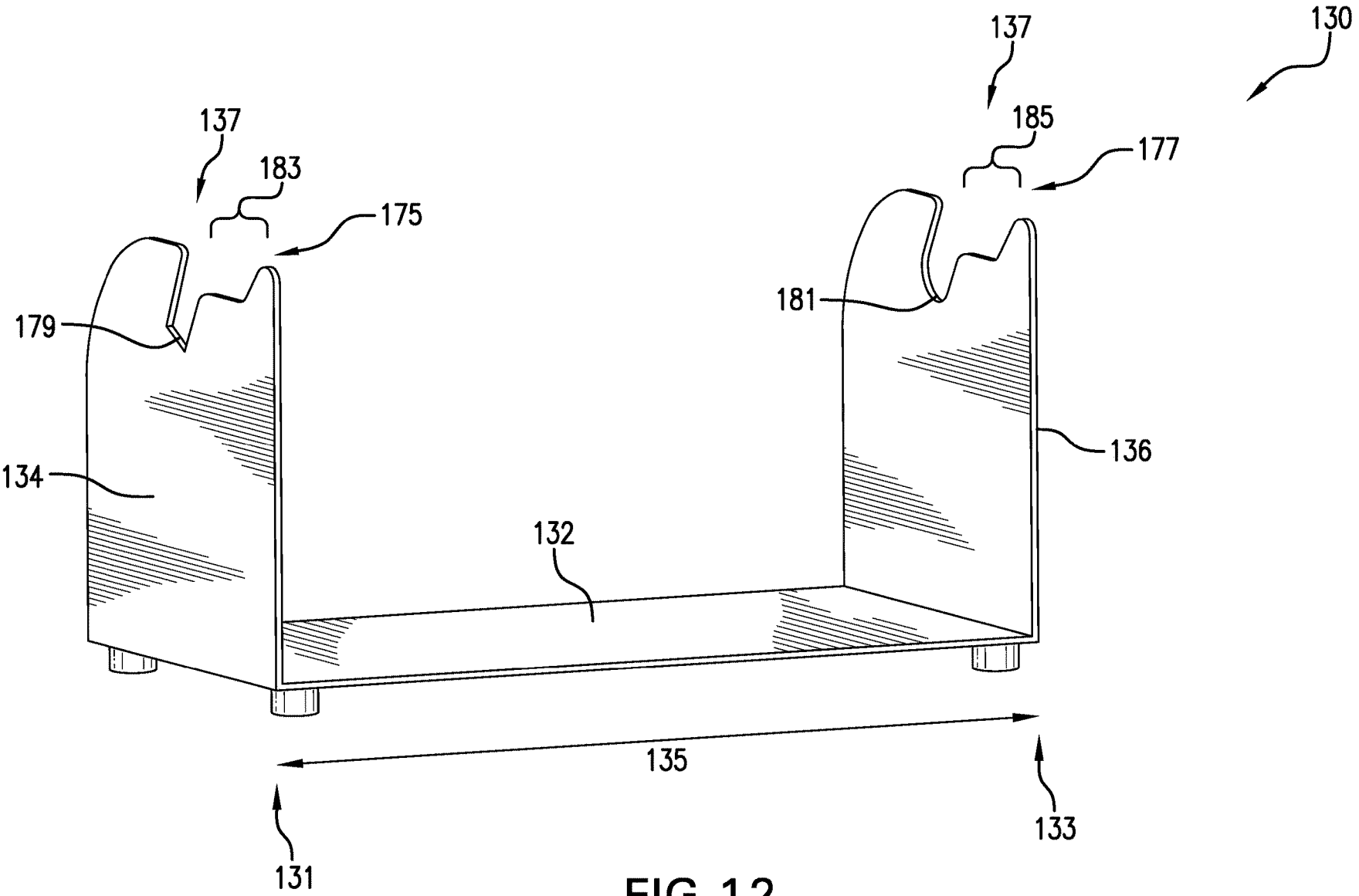
FIG. 12 is a perspective view of the base of the roll dispenser of FIG. 10.

FIGS. 10-12 depict a second embodiment of a roll dispenser according to the present disclosure. In the second embodiment, the roll dispenser is provided with a chuck assembly preferably including a single chuck unit 120, as distinguished from the multiple chuck units described with respect to the first embodiment.

FIG. 10 is an exploded, perspective view of a roll dispenser 110 including a base 130 and the single chuck unit 120 having a plurality of plugs. The single chuck unit 120 is described below in greater detail with reference to FIG. 11. The base 130 is described in greater detail below with reference to FIG. 12.

FIG. 11 is an exploded view of the single chuck unit 120 depicted in FIG. 10. As shown, a compression train may include a first side 142 with an interface 150 for adjusting a compression force acting on the roll dispenser 110, and a second side 144 including a shaft 162 configured to be received by at least a slot provided in the base 130 (see FIG. 12). The shaft 162 preferably extends between a first end 163 and a second end 165. The shaft 162 is configured to receive a generally planar second pad 174. In addition, a first portion 164 of the shaft 162 may serve as an anti-rotation element, where the first portion 164 preferably is provided adjacent to the first end 163 of the shaft 162.

The first side 142 of the compression train includes a generally planar first pad 170, a first plug 160 coupled to the first pad 170, a second plug 184, a first mount 172 interposed between the first plug 160 and the second plug 184, and a second mount 188 positioned on a side of the second plug 184 opposite the first mount 172. Each of the first pad 170, the first plug 160, the second plug 184, the first mount 172, and the second mount 188 include respective channels extending therethrough that are dimensioned to receive the shaft 162.

The interface 150 may include a knob 154 (or handle), a threaded rod 152 extending from the knob 154, and a threaded channel 167 formed in the second end 165 of the shaft 162. In use, the shaft 162 preferably is inserted within the channels of the second pad 174, the first plug 160, the second plug 184, the first mount 172, and the second mount 188, and the threaded rod 152 preferably is engaged with the threaded channel 167 formed inside the shaft 162. So configured, the first pad 170 and the second pad 174 face each other. The compressive force between the first and second sides 142, 144 of the compression train is adjusted by rotation of the knob 154, which urges the first pad 170 and the second pad 174 toward or away from each other.

Optionally, the single chuck unit 120 may include one or more springs, as discussed above, to permit more gradual adjustment of the compression force, as compared to when the spring(s) are absent. The spring(s) may be provided in the first side 142 of the compression train, the second side 144 of the compression train, or in both the first and second sides 142, 144 of the compression train. For example, as shown in FIG. 11, a spring 155 may be arranged between the second plug 184 and the second mount 188, and an additional spring 157 may be arranged between the first plug 160 and the first mount 172.

Optionally, a friction layer 166 may be provided on at least one of the first and second pads 170, 174. The friction layer 166 preferably is formed from a material that increases friction arising from rotation of the second pad 174 with respect to the first pad 160 when the first and second pads 160, 174 are placed in contact with each other. In certain embodiments, the friction layer 166 may be formed from vinyl. However, other materials that increase friction between two surfaces in contact may be employed. In embodiments where two friction layers are employed, e.g., a first friction layer arranged on the first pad 160 and a second friction layer arranged on the second pad 174, the first and second friction layers may be formed from the same material or from different materials.

The first plug 160 and the second plug 184 are configured to engage the core 4 of the roll 2 of stock material. In an embodiment, the first plug 160 may include an internal mount (not labeled) and a first plurality of ribs 161 mounted circumferentially thereon. The second plug 184 may include an internal mount (not labeled) and a second plurality of ribs 186 mounted circumferentially thereon. Each of the first and second plurality of ribs 161, 186 may extend radially outwardly from the rotation axis when the single chuck unit 120 is mounted to the base 130.

The first and second plurality of ribs 161, 186 are dimensioned such that radially facing surfaces of the first and second plurality of ribs 161, 186 contact an inner circumference of the core 4 of the roll 2 of stock material. In this manner, the single chuck unit 120 may be coupled to the roll 2 of stock material by an interference fit between the core 2 and the first and second plugs 160, 184, respectively.

FIG. 12 is a perspective view of an embodiment of the base 130 configured for use with the roll dispenser 110 of FIG. 10. As shown, the base 130 includes a base support 132 extending in a longitudinal direction, and a pair of supports 134, 136 extending from a first end 131 and a second end 133 of the base support 132 to respective free ends 137. The pair of supports 134, 136 may be generally planar and mounted to the base support 132 substantially parallel to each other, while being arranged substantially orthogonal to the base support 132. In addition, the pair of supports 134, 136 are longitudinally offset from each other by a longitudinal offset 135.

First and second slots 175, 177 may be formed at opposite free ends 137 of the pair of supports 134, 136, respectively, the first and second slots 175, 177 being positioned away from an intersection between the supports 134, 136 and the base support 132. The first slot 175 preferably is configured to receive the first portion 164 of the shaft 162. The second slot 177 preferably is configured to receive the second mount 188. Thus, when the first portion 164 of the shaft 162 is received within the first slot 175 and the second mount 188 is received within the second slot 177, the single chuck unit 120 and the roll 2 of stock material mounted thereto are supported by the base 130.

In an embodiment, the first portion 164 of the shaft 162 has a cross-sectional shape with two substantially parallel sides, and the first slot 175 includes a locking portion 179 having two substantially parallel sides dimensioned to receive the first portion 164 of the shaft 162. The locking portion 179 of the first slot 175 is configured to inhibit rotation of the first side 142 of the compression train about the rotation axis when the first portion 164 of the shaft 162 is received therein.

As shown in FIGS. 11-12, the second mount 188 preferably has a cross-sectional shape that is generally curved, and the second slot 177 comprises a supporting portion 181 with a curved surface. The supporting portion 181 of the second slot 177 is configured to permit rotation of second side 144 of the compression train about the rotation axis when the second mount 188 is received therein.

The locking portion 179 and/or the supporting portion 181 constitute recessed areas of the pair of supports 134, 136, and thus are configured to receive and support the first and second mounts 172, 188 via gravity.

Optionally, in FIG. 12, the first slot 175 and the second slot 177 may each further include a respective mouth portion 183, 185 having a stepped entry area. When present, the mouth portion 183 of the first slot 175 is interposed between the locking portion 179 and the free end 137 of the first support 134 and has a width greater than the locking portion 179. When present, the mouth portion 185 of the second slot 177 is interposed between the supporting portion 181 and the free end 137 of the second support 136 and preferably has a width greater than the supporting portion 181. The larger widths of the mouth portions 183, 185 of the first and second slots 175, 177, as compared to the widths of the locking portion 179 and the supporting portion 181, may facilitate insertion of the single chuck unit 120 (e.g., the first portion 164 of the shaft 162 and the second mount 188) in the first and second slots 175, 177.

In further embodiments, the lengths of the first and second slots 175, 177 may extend at a non-zero angle with respect to a reference line perpendicular to the base support (e.g., a vertical axis). In combination with the mouth portions 183, 185 of the first and second slots 175, 177, the angle of the first and second slots 175, 177 with respect to the reference line may facilitate insertion of the single chuck unit 120 in the first and second slots 175, 177.

As shown in FIG. 12, the first and second slots 175, 177 extend from the free ends 137 of the first and second supports 134, 136. However, in alternative embodiments (not shown), the first slot 175 may extend from a side of the first support 134 extending along at least a portion of the length of the first support 134, and the second slot 177 may extend from a side of the first support 136 extending along at least a portion of the length of the first support 136. As noted above, the above-described arrangement of the first and second slots 175, 177 may facilitate mounting the base 130 in different orientations (e.g., a table mount and a wall mount). In certain embodiments, the base 130 may include pairs of the first and second slots 175, 177 extending from ends and/or sides of the first and second supports 134, 136.

Figure 13:
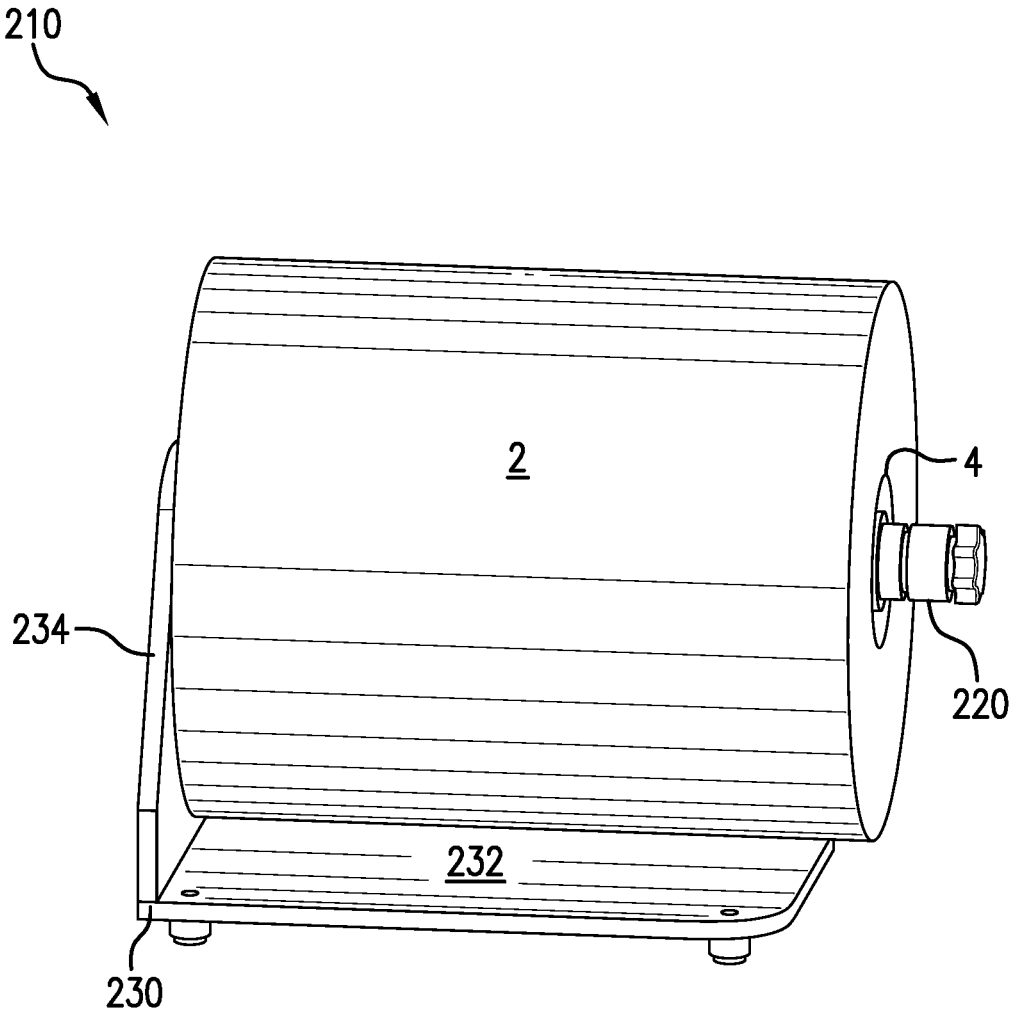
FIG. 13 is a view of a third embodiment of the roll dispenser including a base and a chuck assembly secured thereto in a cantilever configuration and a roll of stock material mounted thereto.
Figure 14:
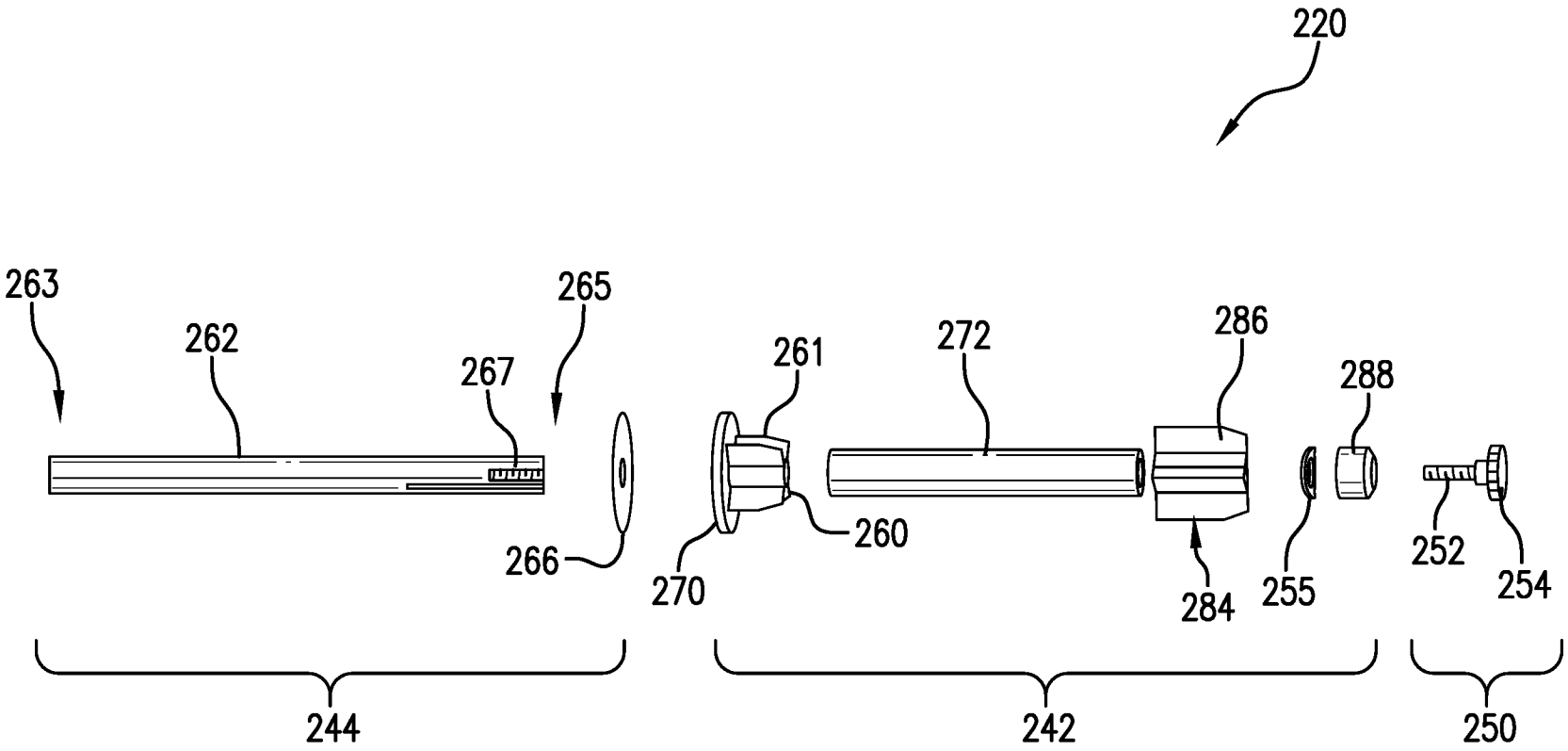
FIG. 14 is an exploded view of the chuck assembly of FIG. 13.
Figure 15:
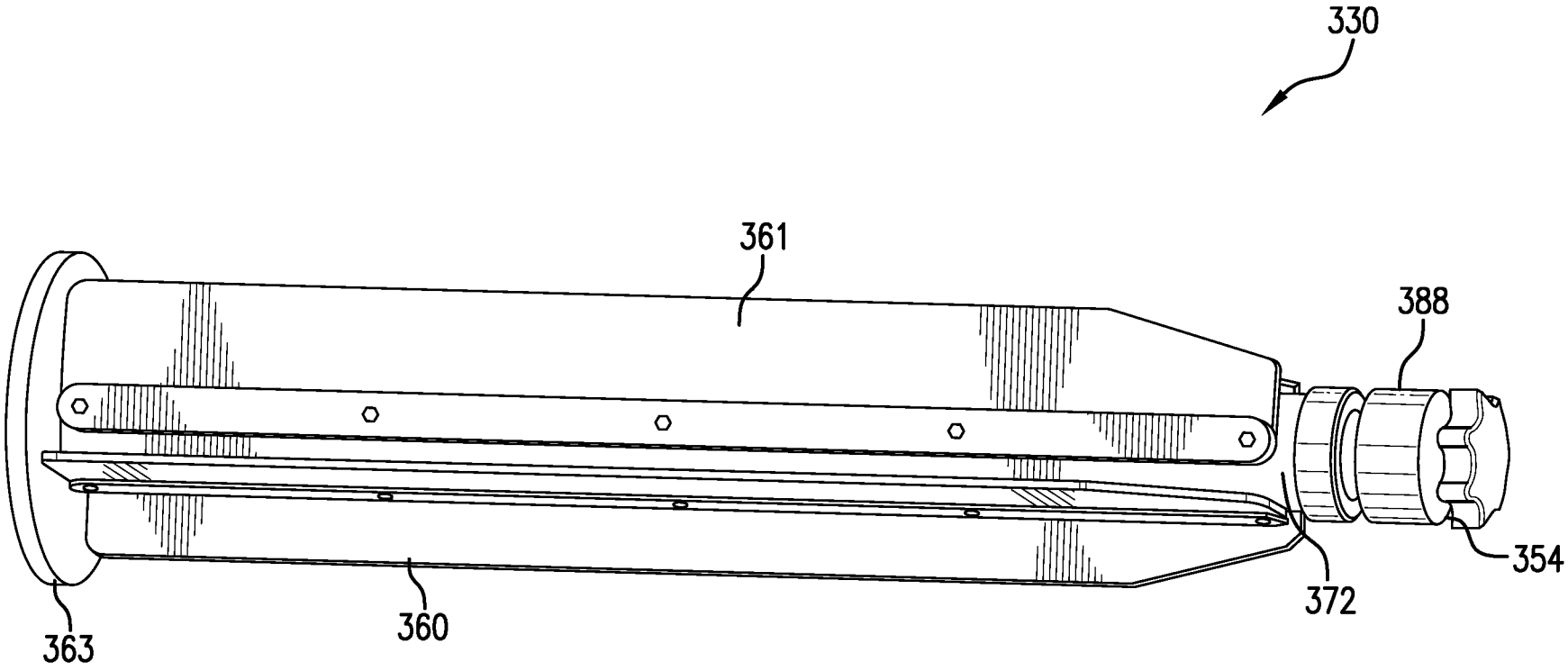
FIG. 15 is an alternative embodiment of a chuck assembly for the roll dispenser of FIG. 13.

FIGS. 13-15 depict a third embodiment of a roll dispenser 210 according to the present disclosure. In the third embodiment, the roll dispenser is provided with a chuck assembly preferably including a single chuck unit 220, where FIG. 15 is an alternate variation of the single chuck unit 220 depicted in FIGS. 13-14.

Referring to FIG. 13, the single chuck unit 220 is configured to be secured to a base 230 in a cantilever configuration with the roll 2 of stock material mounted thereto. An exploded view of the chuck assembly of FIG. 13 is shown in FIG. 14.

As shown in FIG. 13, the base 230 includes a base support 232 extending in a longitudinal direction and a single, generally planar support 234 mounted to a first surface of the base support 232. In contrast to embodiments discussed above, an end of the single chuck unit 220 is configured to be coupled to the support 234, rather than received within a slot.

The chuck assembly of FIG. 13 is similar to the embodiment depicted in FIG. 11. However, a first end 263 of a shaft 262 is configured to be rigidly coupled to the support 234. As a result, a second side 244 of a compression train includes the support 234 of the base 230, and the first end 263 of the shaft 262 is rigidly coupled to the support 234 of the base 230 and serves as an anti-rotation element.

Similar to the embodiment of FIG. 11, the first side 242 of the compression train includes a generally planar pad 270, a first plug 260 coupled to the base 270, a second plug 284, a first mount 272 interposed between the first plug 260 and the second plug 284, and a second mount 288 positioned on a side of the second plug 284 opposite the first mount 272. Each of the base 270, the first plug 260, the second plug 284, the first mount 272, and the second mount 288 include respective channels extending therethrough that are dimensioned to receive the shaft 262.

Likewise, similar to the embodiment of FIG. 11, an interface 250 includes a knob (or handle) 254, a threaded rod 252 extending from the knob 254, and a threaded channel 267 formed in the second end 265 of the shaft 262. The interface 250 is configured to adjust the compressive force by rotation of the knob 254 to urge the base 270 toward or away from the support 234.

Optionally, a friction layer 266, as discussed above, may be provided on the surface of the support 234 opposite the base 270, on the surface of the base 270, or both.

Optionally, one or more springs (e.g., a spring 255) may be provided in the first side 242 of the compression train, the second side 244 of the compression train, or both the first and second sides 242, 244 of the compression train.

The first plug 260 and the second plug 284 may be configured as discussed above to engage the core 4 of the roll 2 of stock material. In an embodiment, the first plug 260 may include an internal mount (not labeled) and a first plurality of ribs 261 may be mounted circumferentially thereon. The second plug 284 may include an internal mount (not labeled) and a second plurality of ribs 286 mounted circumferentially thereon. Each of the first and second plurality of ribs 261, 286 may extend radially outwardly from the rotation axis.

The roll 2 of stock material may be mounted to the roll dispenser 210 by moving the roll 2 horizontally while the core 4 and single chuck unit 220 are axially aligned. The first and second plurality of ribs 261, 286 are dimensioned such that radially facing surfaces of the first and second plurality of ribs 261, 286 contact an inner circumference of the core 4 of the roll 2 of stock material. In this manner, the single chuck unit 220 may be coupled to the roll 2 of stock material by an interference fit between the core 4 and the first and second plugs 260, 284, respectively.

FIG. 15 illustrates a variation of a chuck assembly including a single chuck unit 330 as an alternative to the single chuck unit 230 in the roll dispenser 210 of FIG. 13. The single chuck unit 330 of FIG. 15 is constructed and operated in a manner similar to that of the single chuck unit 230 of FIG. 12, with the exception that the first and second plugs 260, 284 are replaced by a single plug 360 operably connected to a shaft 363, where the single plug 360 is composed of a plurality of radial fins 361 mounted to an outer surface of a first mount 372, where the radial fins 361 may be arranged circumferentially around the first mount 372. So constructed, the radial fins 361 may extend along at least a portion of the length of the first mount 372. A second mount 388 has a similar structure and function to the second mount 288 depicted in FIG. 12. In particular, compressive force in a longitudinal/axial direction can be adjusted by use of a knob 354 or handle.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A roll dispenser for supporting a roll of packaging material, the roll dispenser comprising:

a base; and a chuck assembly including a first chuck unit, wherein the first chuck unit comprises:

a first mount mounted to the base such that the base limits rotation of the first mount mounted thereto;

a first plug configured to be inserted in a first axial end of a core of the roll of packaging material and locked into rotation with the core;

a first brake operably associated with the first plug and the first mount so as to establish friction therebetween that resists rotation of the first plug with respect to the first mount as the packaging material is pulled from the roll; and a spring element operably connected to the first brake, the spring element configured to exert a tensile force in an axial direction for regulating the friction between the first mount and the first plug.

2. The roll dispenser of claim 1, further comprising a first handle assembly connected to the first plug, and configured to adjust a first compressive force applied in the axial direction so as to regulate the friction between the first mount and the first plug.

3. The roll dispenser of claim 2, wherein the first plug includes a distal portion for insertion in the first axial end of the core of the roll of packaging material, and a proximal portion defining a first shaft.

4. The roll dispenser of claim 3, further comprising a pressure cap arranged between the first mount and the first handle assembly, wherein the pressure cap defines a cavity dimensioned to receive at least a portion of the first shaft.

5. The roll dispenser of claim 4, wherein the spring element is positioned around an outer circumference of the first shaft and between an end of the first mount and an end of the pressure cap opposite the first handle assembly.

6. The roll dispenser of claim 3, wherein the first plug and the first shaft are configured to rotate together about the rotation axis.

7. The roll dispenser of claim 3, wherein the first handle assembly is operably connected to the first shaft.

8. The roll dispenser of claim 2, wherein the chuck assembly further comprises a second chuck unit, the second chuck unit comprising:

a second plug configured to be received in a second axial end of the core of the roll of packaging material;

a second shaft operably connected to the second plug; and a second mount configured to be connected to the second shaft.

9. The roll dispenser of claim 1, wherein the first handle assembly is configured to be rotated manually by an operator or automatically by a machine.

10. The roll dispenser of claim 1, wherein the first plug is configured to rotate about a rotation axis in the axial direction, while the first mount is inhibited from rotation about the rotation axis.

11. The roll dispenser of claim 1, wherein the roll of packaging material comprises a roll of expandable paper comprising a plurality of slits.

12. The roll dispenser of claim 11, wherein the first brake is configured to regulate the friction between the first mount and the first plug so as to be sufficient to open one or more slits of the expandable paper without tearing the expandable paper.

13. The roll dispenser of claim 1, wherein the first mount includes a non-circular outer surface configured to contact the base so as to prevent rotation in the axial direction.

14. The roll dispenser of claim 1, wherein the first brake comprises a generally planar first pad coupled to the first mount and a generally planar second pad coupled to the first plug, and the friction is established by contact between the first and second pads.

15. A base for a roll dispenser configured to support a roll of packaging material, the base comprising:

a base support extending in a longitudinal direction; and a pair of supports extending transversely from the base support, the pair of supports each defining a first end and a second end, wherein the first end of each of the pair of supports is mounted to a first surface of the base support, wherein at least one slot is formed adjacent to the second end of each of the pair of supports, and wherein the at least one slot of a first support of the pair of supports is configured to receive the first mount of the first chuck unit and the at least one slot of a second support of the pair of supports is configured to receive the second mount of the second chuck unit to thereby support the chuck assembly.

16. The base of claim 15, wherein the base support is configured to be mounted to a vertical wall such that the base support is substantially flush with the vertical wall, or to be mounted on a horizontal surface.

17. The base of claim 15, wherein the at least one slot includes a stepped entry area for receiving the first mount or the second mount, and a recessed area for holding the first mount or the second mount by gravity.

18. The base of claim 15, wherein the at least one slot comprises a first slot and a second slot, wherein the first slot extends from the second end of each of the pair of second supports, and wherein the second slot extends from a side of each of the pair of supports, the side being positioned between the first and second ends of the pair of supports.

19. A system for dispensing packaging material from a roll arranged on a roll dispenser, the system comprising:

a base;

a chuck assembly including a first chuck unit, wherein the first chuck unit comprises:

a first mount mounted to the base such that the base limits rotation of the first mount mounted thereto;

a first plug configured to be inserted in a first axial end of a core of the roll of packaging material and locked into rotation with the core;

a first brake operably associated with the first plug and the first mount so as to establish friction therebetween that resists rotation of the first plug with respect to the first mount as the packaging material is pulled from the roll; and a spring element operable connected to the first brake, the spring element configured to exert a tensile force in an axial direction for regulating the friction between the first mount and the first plug; and the roll of packaging material being supported by the base with the first plug inserted into the core.

20. The system of claim 19, wherein the first brake comprises a generally planar first pad coupled to the first mount and a generally planar second pad coupled to the first plug, and the friction is established by contact between the first and second pads.

21. The system of claim 19, wherein the roll of packaging material comprises a roll of expandable paper comprising a plurality of slits, and the first brake is configured to regulate the friction between the first mount and the first plug so as to be sufficient to open one or more slits of the expandable paper without tearing the expandable paper.

* * * * *